United States Patent [19]

Mims et al.

[11] Patent Number: 4,565,245

[45] Date of Patent: Jan. 21, 1986

[54] COMPLETION FOR TAR SAND SUBSTRATE

[75] Inventors: Donald S. Mims; Richard S. Allen, both of Houston, Tex.

[73] Assignee: Texaco Inc., White Plains, N.Y.

[21] Appl. No.: 492,867

[22] Filed: May 9, 1983

[51] Int. Cl.[4] ..... E21B 43/24; E21B 36/00

[52] U.S. Cl. ..... 166/50; 166/73; 166/187; 166/272; 166/306

[58] Field of Search ..... 166/50, 271, 272, 303, 166/306, 67, 72, 73

[56] References Cited

U.S. PATENT DOCUMENTS

| | | | |
|---|---|---|---|
| 3,126,961 | 3/1964 | Craig, Jr. et al. | 166/306 X |
| 3,428,124 | 2/1969 | Armstrong | 166/187 |
| 4,026,359 | 5/1977 | Closmann | 166/271 X |
| 4,116,275 | 9/1970 | Butler et al. | 166/50 X |
| 4,362,213 | 12/1982 | Tabor | 166/303 X |
| 4,368,781 | 1/1983 | Anderson | 166/50 X |

*Primary Examiner*—Stephen J. Novosad

*Attorney, Agent, or Firm*—Robert A. Kulason; Robert B. Burns

[57] ABSTRACT

Method and apparatus for recovering hydrocarbons from a subterranean formation in which a well completion, including a well liner, lies in a generally horizontal disposition within the hydrocarbon productive substrate. The liner encloses conductor means for delivering a stream of a hot stimulating agent to the well's remote or injection end, and means for regulating the production of bitumen emulsion from the producing end thereof. A fluid impervious barrier is movably interposed in the well liner between the injection end and the producing end to establish a pressure differential across said barrier thereby directing a flow of stimulating agent into the substrate. Said agent, by liquefying bitumen, creates a pattern of paths along which the mixture flows toward the well's lower pressure producing end. By progressively moving the barrier toward said producing end, the flow path pattern can be extended into a broader area of the substrate.

1 Claim, 3 Drawing Figures

10
11
12
13
14
15
16
17
18
19
21
22
22'
23
24
26
27
28
31
32
33
34
36
37
2
A
B
41
42
43
44
46
47

COMPLETION FOR TAR SAND SUBSTRATE

BACKGROUND OF THE INVENTION

In the production of viscous hydrocarbons such as heavy crude, or bitumen from tar sands, it is necessary to thermally stimulate the relatively viscous hydrocarbon material such that it can flow and be withdrawn from the substrate as an emulsion. Usually, thermal stimulation comprises the introduction of hot aqueous heating mediums such as pressurized steam, into the substrate by way of an injection well to contact the bitumen.

This stimulating step over a period of time fluidizes the bitumen and releases it from the tar sand. The steam also establishes a pressure front whereby to urge the now flowable hydrocarbon emulsion or mixture toward one or more production wells.

The present method and apparatus are applicable to producing either bitumen from tar sand, or heavy viscous crude oil from a substrate. To simplify the following description, only bitumen will be referred to as the produced material.

Since the hot steam will condense under proper conditions, the product formed by the bitumen comprises in essence an aqueous mixture. Although said product could be considered as being an emulsion, depending on the condition thereof, it will be hereinafter referred to as an aqueous bitumen mixture.

In one method adapted to this type of viscous hydrocarbon production, it is found practical to utilize a single well which is sequentially heated, and produced on a cyclical principle. More specifically, the environment around the well is initially preheated to put the bitumen into a flowable condition. Thus during a soak period, heat is absorbed into the substrate about the well, causing the hot flowable material to gravitate toward the well. Thereafter, the stimulating step is continued in such manner that the hot mixture will continue to flow and to be produced from the well.

When over a period of time, pressure within the substrate deteriorates or the production flow decreases, it is necessary to recommence the cycle by further introduction of stimulating medium. As a sufficiently high pressure is reestablished and the bitumen solution is again caused to flow, steam injection is discontinued or minimized. Further controlled draw-down of the bitumen mixture can now be resumed.

This cyclical process can be continued indefinitely until the substrate adjacent to the well becomes exhausted of producible hydrocarbon product. Because of its general character, the method is referred to generally as the huff and puff process. It is found to function efficiently particularly when the stimulating medium is steam.

In an alternate method for producing viscous hydrocarbons from this type of substrate, a plurality of generally vertical wells are drilled in a desired surface pattern. Thereafter, stimulating fluid such as steam is injected for a period of time into the substrate through a centrally located injector well.

The heated or stimulated area about the well will be progressively widened, thereby establishing a pressure front which drives flowable bitumen mixture toward the surrounding producing wells. This process enjoys the advantage of being practiced by the continuous introduction of the hot stimulating medium, and thus yield a continuous outflow.

It is now found desirable toward achieving an improved bitumen production rate, to utilize a generally horizontally disposed well for producing from a relatively thin hydrocarbon containing layer. Due to the nature of this type of well, the latter must as herein noted, operate on a cyclical basis to achieve an appreciable outflow of the bitumen mixture. Since cyclical operation amounts to a disruption of the producing phase it constitutes a less than economical expedient.

To realize an improved production rate from a horizontal well of the type contemplated, there is presently provided an efficient method and apparatus for producing a hot, aqueous bitumen mixture from a tar sand or similar environment. The process is effectuated through a single, elongated horizontal well which lies in at least a portion of a tar sand layer, preferably in a direction concurrent with the layer's direction.

Both the horizontal well itself and the adjacent substrate, are initially preheated to establish a favorable operating temperature at which fluidized bitumen mixture becomes mobile. The well includes means to establish a pattern of paths through the productive layer along which the bitumen mixture will readily flow. Said path thereby communicates a relatively high pressure injection area where the stimulating fluid is introduced, with a low pressure area in the well toward which the mixture gravitates.

Thereafter, and subsequent to the preheating step, the horizontal well is produced by regulated further introduction of a hot stimulating fluid. This latter injection, together with control of the well back pressure, causes fluidized bitumen mixture to be urged toward the well producing end. At high temperature conditions, all or a part of the stimulating steam will be produced with the mixture.

To maintain a favorable production output, the substrate is most effectively swept clean of removable bitumen by adjusting the injection pattern formed by the stimulating fluid path. The latter is achieved by diverting the flow of stimulating steam which penetrates the substrate, whereby to change the relationship between the high pressure or injection end of the liner, and the low pressure or production end thereof.

It is therefore an object of the invention to provide a method and apparatus for improving the production of viscous hydrocarbon fluid from a subterranean reservoir in which the hydrocarbon fluid is locked. A further object is to provide a method and apparatus for stimulating and producing a well aligned substantially horizontally in the formation, and containing a relatively viscous hydrocarbon. A still further object is to provide a method and apparatus for the continuous production of a viscous hydrocarbon fluid from a single well disposed substantially horizontally through a productive formation.

Figures 1, 2, 3:
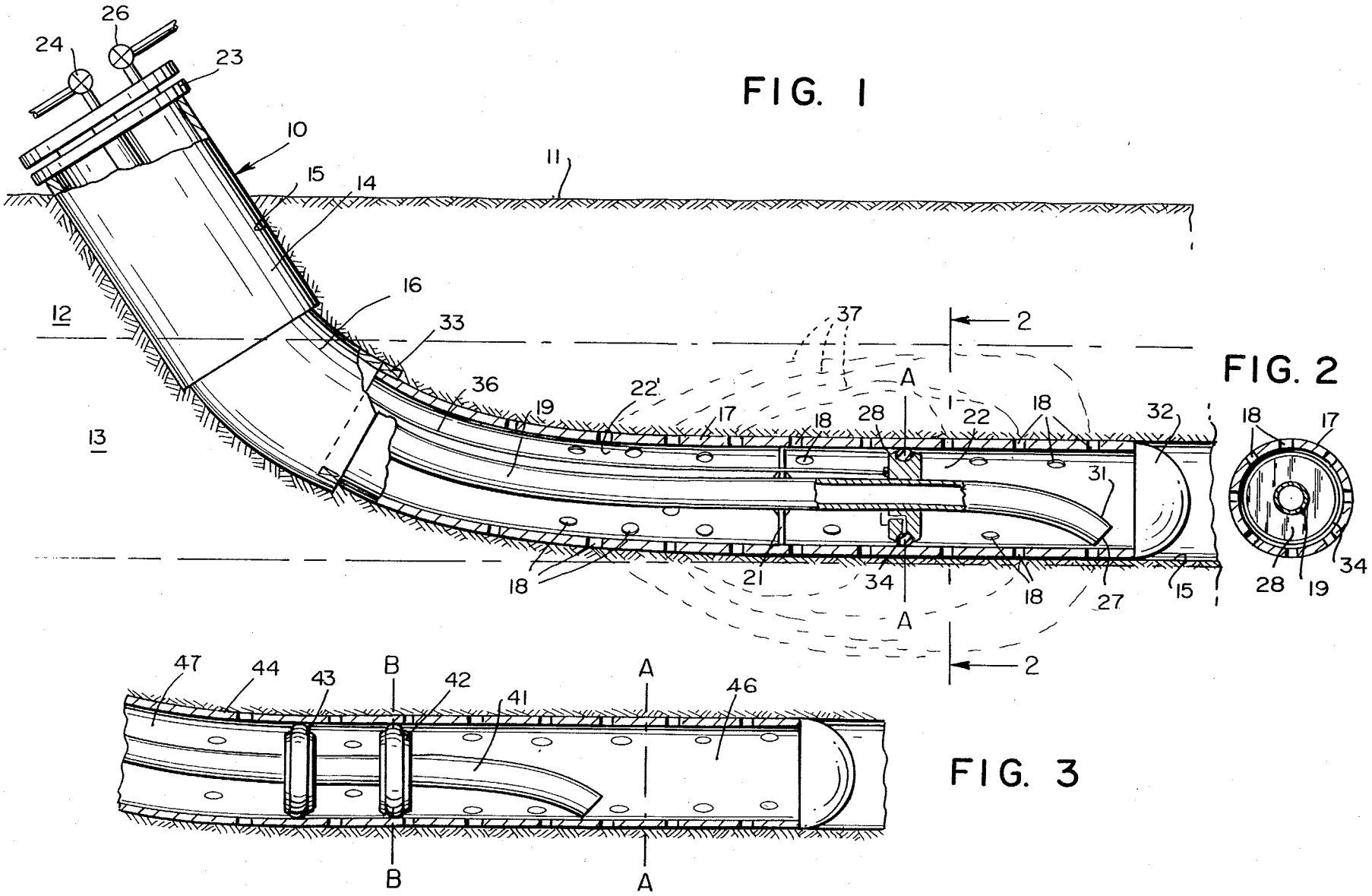
FIG. 1 is an elevation view in cross-section of a horizontal well of the type contemplated.
FIG. 2 is a cross-sectional view taken along line 2—2 in FIG. 1.
FIG. 3 is similar to FIG. 1 showing an alternate embodiment of the disclosed structure.

Referring to the drawings, a well 10 of the type contemplated is shown which enters the ground vertically, or preferably at an angle to the surface 11. Wellbore 15 is initially started through overburden 12 which overlies the productive or tar sand layer 13.

Thereafter, partway through the overburden layer bore 15 is deviated in a manner that at least a segment of the bore lies in a generally horizontal relationship with respect to the layer 13 as well as to the earth's surface 11. Further, the well's horizontal segment is preferably positioned at a depth whereby to be adjacent to the lower border of the generally horizontal, hydrocarbon containing layer 13. Following the usual drilling practices, wellbore 15 is provided at its upper end with a series of casing lengths 14 and 16 which are affixed in place.

An elongated liner 17 is inserted through the respective casings 14 and 16, and supported in casing 16 by a liner hanger 33. The latter is structured to permit passage of bitumen emulsion, or hot stimulating fluid therethrough during the producing or injecting stages of the operation. Liner 17 can be provided at its forward or remote end with a bull hose 32 or similar means to facilitate its being slidably inserted into the wellbore.

Structurally, liner 17 comprises a steel, pipe-like member being perforated as required along that portion of the wall which lies within the tar sand layer 13. The perforations 18 can take the form of a series of holes in the liner wall. Alternately they can comprise slotted openings which extend either longitudinally or peripherally about the liner. Further, said perforations can be formed either before or after the liner is placed within the bore 15.

In any event, liner openings 18 are adequate to allow the discharge of heating medium therethrough and into the adjacent tar sand substrate 13. Further, they allow the return flow or the entry of a hot, aqueous bitumen mixture through the same wall openings after said mixture achieves a flowable state.

An elongated fluid carrying conductor or conduit 19 is disposed internally of liner 17. Conductor 19 can rest on liner 17 wall or it can be supported by spaced apart stabilizers 21 which attach to the conductor.

Conductor 19 is constructed of continuous tubing or alternately of pipe lengths which are interconnected end to end. Said conductor is capable of carrying a pressurized (about 200 to 500 psi) stream of hot stimulating fluid such as steam, hot water or either of said elements having appropriate chemicals intermixed therewith to facilitate the producing step. The condition of the injected fluid will depend on the composition of the substrate 13. Under particular circumstances, conductor 19 can also function to conduct hot bitumen mixture from liner 17.

Elongated conductor 19, if supported within liner 17, defines an annular passage 22, 22', for at least a part of the liner length. It can however rest directly on the conductor wall.

The upper external ends of the respective liners 17 and conductor 19 are provided with a closure means 23 such as a well head. The latter includes valves 24 and 26 which are operable to permit selective and controlled communication of the individual liner passages with a source of stimulating liquid.

In one embodiment of the apparatus, to initiate production of emulsion the entire well completion 10 is first preheated to adjust it to proper temperature and pressure conditions whereby to function within the tar sand substrate 13. This is achieved by connecting annular passage 22' to a source of the steam by way of valve 26. Concurrently, stimulating fluid such as steam at about 300 to 500 psi is introduced through well head 23 by way of valve 24, to elongated conductor 19. It is then conducted the full length of said conduit to the discharge opening 27 at the remote end thereof.

A first portion of the hot pressurized steam will enter liner 17, end chamber 31 and flow outwardly into the adjacent substrate 13 through perforations 18 in the liner wall.

A second portion of the steam flow will reverse its direction and be forced back along annulus 22 counter to the flow of the incoming steam in conductor 19. The steam will thereafter dissipate through openings 18 along a segment of the length of liner 17.

When steam is introduced by way of conductor 19 it progresses in a general upward direction through substrate 13 thereby fluidizing the bitumen and forming flow paths 37. Because of the lowered ambient pressure within liner 17 annular chamber 22', the emulsion will gravitate toward the latter.

During this preheat or soak period, the well's back pressure will have decreased considerably. The heating or stimulating fluid will nonetheless still pass from annulus 22' and enter the substrate 13 surrounding the liner 17 even though the steam is characterized by a reduced heating capacity.

Over a period of time, the soil in layer 13 surrounding well 10 will become preheated as the steam condenses. This will gradually put the contacted bitumen into a flowable emulsion. Due to the pressure drop of steam along annular passage 22', a pressure differential will be established between the well injection end and the producing end.

Further, steam which enters substrate 13 will, although exhibiting a tendency to flow upwardly, establish a progressively expanding heated area and heated paths 37 along which hot fluidized bitumen mixture can readily flow. Thus the flowable mixture will further gravitate to the lower pressured end of liner 17 and be thereafter urged toward well head 23.

When substrate 13 becomes sufficiently preheated, steam flow through the annulus 22' is discontinued and the hot stimulating injection is then maintained only through conductor 19. This heating step will emphasize liquefying of the bitumen at the well injection end, and further maintain the desired pressure differential in liner 17 between the producing and injection ends.

To promote and improve the flow of hot bitumen mixture through substrate 13, the well completion includes means whereby a definitive pressure drop is established between the injection end of the well, and a series of points along the well approaching the producing end. This objective is achieved by interposing a displaceable barrier 28 which is impervious to the flow of steam or stimulating fluid, in a manner to define and separate annular chambers 22 and 22'.

In one embodiment, barrier 28 comprises a packer of the type normally associated with well operations. The packer is operably positioned within liner 17 to support and locate conductor 19.

Barrier 28 however functions such that it can be slidably displaced along conductor 19 to a desired location therein and activated to expanded condition against the liner 17 wall whereby to maintain its location.

As a result, entering stimulating fluid such as pressurized steam, upon leaving the discharge end 27 of fluid conduit 19, will enter annular chamber 22. A major portion of the steam flow will as herein noted pass outwardly to penetrate the adjacent substrate 13 still having an elevated pressure and temperature.

Continued pressurized injection of the hot steam from conduit 19 will continue to melt the bitumen into flowable condition thereby further prompting its formation into a hot emulsion with steam condensate.

With the continued steam injection, the area of heated substrate will be progressively broadened particularly upwardly. Concurrently, elevated substrate pressures at the well injection end will urge the fluidized mixture toward the lower pressure production end of the well downstream of barrier 28 and into annulus 22', by way of the flow pattern formed by paths 37.

Eventually, the hot bitumen mixture in moving through the substrate toward the lower pressure production end of liner 17, will establish and widen the various flow paths 37. The bitumen mixture will then enter ports 18 of liner 17. At this point in the process, some of the injected steam may also enter liner 17 by way of the diverse flow paths, and will be produced through well head 23. By regulating the back pressure in annular passage 22', the flow of the hot bitumen mixture or emulsion to the well head 23 can be regulated. Alternatively, the hot emulsion can be pumped or otherwise withdrawn from the liner.

Toward achieving the desired optimum substrate penetration with stimulating medium, fluid impervious barrier 28 is positioned on and depends from conductor 19. Barrier 28 is initially located adjacent to the remote or forward end of conduit 19 and spaced from discharge opening 27. Barrier 28 in accordance with the invention, can assume any one of a number of embodiments which achieve a primary objective of functioning as a substantially impervious deterrent to fluid flow through annulus 22.

In one embodiment of the invention, barrier 28 comprises basically an annular body or bodies which extend from and which are fixed to conductor 19 by welding or by a suitable clamping means. Thus the barrier can be longitudinally displaced along liner 17 when conductor 19 is withdrawn through the well liner.

The barrier can assume the embodiment of a plurality of packers which are spaced apart and which include a torus-like peripherally expandable member 34. Such expandable members are well known and used in the petroleum producing industry for down hole operations. Physically, they are actuated through a hydraulic or pneumatic system represented by conduit 36 to radially engage the inner wall of liner 17.

As shown in FIG. 3, the barrier assembly comprises a plurality of expandable members 42 and 43. The latter are spaced apart and fixed on conductor 41 such that the entire assembly can be slidably adjusted as a unit along the inner wall of liner 44.

As in the previously described embodiment, the fluid barrier functions to segregate the liner into an injection end or chamber 46, and producing end or chamber 47. Displacement of the barrier along liner 44 from point A to point B, serves to lenghten chamber 46 and concurrently compress or shorten chamber 47.

Due to the nature of the liner's perforated wall, it is appreciated that barrier 28 will not necessarily form a completely fluid tight engagement therewith. The annular connection with the liner, however, will be sufficiently fluid tight to serve the present purpose.

Referring to FIG. 1, to be actuated from its contracted position into engaging condition, the expandable portion 34 of barrier 28 is communicated with a controllable source of a pressurized gas such as air by way of conduit 36. The latter preferably extends along conductor 19 to well head 23.

To assemble the well completion 10 to a desired position within tar sand layer 13, wellbore 15 is first formed as herein noted. To follow one option, barrier 28 and conduit 19 are initially assembled within liner 17 prior to the latter being inserted into wellbore 15. The discharge end 27 of conductor 19 will thus normally be positioned adjacent to the liner 17 remote or injection end.

Thereafter, liner 17 is slidably urged along wellbore 15 until reaching its desired location. Thus, the discharge end 27 of conductor 19 will open into terminal chamber 31 defined by the wellbore end wall and barrier 28.

As herein described initial preheating of the well and its contiguous substrate is commenced during a soaking period of normally several weeks. After this preheating period, the stimulation step follows by injecting heated stimulant in a way that it will tend to flow from the liner injectin end, toward the well's producing end.

Eventually the steam saturated segment of substrate 13 will become depleted of bitumen. This condition will normally be evidenced at well head 23 by production of steam and/or water, but little hydrocarbon product.

A desired level of emulsion production can be realized by increasing the number of, or by extending flow paths 37 in the substrate. This is realized by displacing conductor 19 from its initial position. Conductor 19 is thus withdrawn through well head 23, a sufficient distance to move barrier 28 toward the well's producing end.

This step is achieved by first actuating barrier 28 to its contracted position thereby freeing it from the surrounding conductor 17 walls. Conductor 19 and barrier 28 can then be pulled concurrently along liner 17 to the latter's relocated position. The repositioning of barrier 28 will in effect axially expand annular chamber 22, but decrease the size of the production annular chamber 22' by a comparable amount.

In its new location as shown in FIG. 3, barrier 28 (now represented in this FIG. 3 as barrier 42) is reactuated into expanded condition and the flow of steam through conductor 19 is continued.

This latter heating phase will extend the heated area of the substrate longitudinally toward the production end of the well. The effect of the barrier adjustment will be evidenced by an increase in the rate at which bitumen mixture is again produced at well head 23.

With the adjustment in barrier 28 from its initial position at A, to its second position at B, the rate of bitumen mixture will continue to increase. This increase reflects the entry of high pressure steam into the heretofore heated, but unproduced area of substrate 13 closer to the well's production end.

Consequently a new set, or extended set of hot flow paths 37 through substrate 13 will gradually be established as the new source of bitumen gradually melts and forms into the flowable mixture.

Production of the bitumen mixture will continue as herein noted until it again becomes evident by the excessive amount of steam and/or water leaving well head 23, that the expanded producing area has been depleted of bitumen.

Over a period of time, barrier 28 will be progressively retracted in a series of steps and repositioned along liner 17 until it approaches the producing end of the liner where the latter leaves layer 13. At this phase of the operation, the substrate area or tar sand layer 13 will have been drained, or substantially depleted of its bitumen content. The horizontal well can thereafter be used as a stimulant injector along its entire length to facilitate production of adjacent wells which are disposed in the area.

The foregoing description for practicing the invention is essentially applicable when the stimulating medium is hot water rather than steam. Further, it can be appreciated that production of bitumen emulsion can be through the central conductor 19 and valve 24 at well head 23. In the latter instance, the hot stimulating medium can be introduced through valve 26 as is done during a preheating step. During this type of operation, the medium flow paths through the tar sand layer will move progressively from the higher pressured production end of the well, toward the remote end thereof.

Thereafter by drawing down the pressure at said well end, the emulsion will be withdrawn and produced through conduit 19.

Although modifications and variations of the invention can be made without departing from the spirit and scope thereof, only such limitations should be imposed as are indicated in the appended claims.

We claim:

1. A well completion for producing viscous hydrocarbons from a substrate layer comprising unconsolidated sand particles in which said hydrocarbon is releasably retained, which completion includes;

an elongated well liner 17 disposed in a wellbore 15 formed within the substrate layer 13, at least a portion of the well of said elongated well liner being perforated 18 and extending in a substantially horizontal disposition through said layer 13, a well head 23 at one end of said elongated liner 17 and including;

fluid flow control valves 24 and 26, fluid barrier means 28 carried on said fluid conduit 19 and being controllably displaceable within said well liner 17 to divided the annular passages 22 and 22' into injection and producing segments respectively at opposed sides of the barrier, said barrier means 28 including;

a radially expandable element which is capable of being expandably actuated to engage the liner 17 inner wall, barrier actuating means including a conduit 36 extending from the well head 23 to said radially expandable element, and means to selectively direct a stream of actuating fluid to said expandable element for urging the latter into the expanded condition and in engagement with the liner 17 wall, said fluid conduit 19 being longitudinally adjustable within liner 17 to displace the fluid barrier means 28 to a desired location, and as said barrier means 28 operably engages fluid conduit 19 to be slidably adjusted therealong, and displacement means engaging barrier means 28 to slidably adjust the position of the latter longitudinally within liner 17.

* * * * *